US005080082A

United States Patent [19]

Mueller et al.

[11] Patent Number: 5,080,082

[45] Date of Patent: Jan. 14, 1992

[54] PRESSURE REGULATING VALVE FOR CRANKCASE VENTILATION IN AN INTERNAL COMBUSTION ENGINE

[75] Inventors: Heinz Mueller, Remseck; Werner Schnabel, Freiberg, both of Fed. Rep. of Germany

[73] Assignee: Filterwerk Mann & Hummel GmbH, Ludwigsburg, Fed. Rep. of Germany

[21] Appl. No.: 698,085

[22] Filed: May 10, 1991

[30] Foreign Application Priority Data

May 26, 1990 [DE] Fed. Rep. of Germany ..... 4017074

[51] Int. Cl.[5] ..... F01M 13/00; F01M 11/04; F01M 11/12; F02B 77/10

[52] U.S. Cl. ..... 123/574; 123/572

[58] Field of Search ..... 123/572, 573, 574

[56] References Cited

U.S. PATENT DOCUMENTS

| | | | |
|---|---|---|---|
| 2,240,459 | 4/1941 | McDowell | 123/574 |
| 4,167,164 | 9/1979 | Bachmann | 123/574 |
| 4,373,499 | 2/1983 | Bendig | 123/574 |
| 4,768,493 | 9/1988 | Ohtaka et al. | 123/574 |

FOREIGN PATENT DOCUMENTS 7822216 4/1979 Fed. Rep. of Germany .

OTHER PUBLICATIONS

Publication No. VKD 7032 of Filterwerk Mann & Hummel GmbH, date unknown.

*Primary Examiner*—Andrew M. Dolinar
*Assistant Examiner*—M. Macy
*Attorney, Agent, or Firm*—Foley & Lardner

[57] ABSTRACT

A pressure regulating valve for venting the crankcase of an internal combustion engine in which the pressure regulating valve is combined with a motor oil filler tube and with an oil dip stick. This combination is distinguished by the fact that it is especially compact, and centrally connects all of the components relating to oil supply and monitoring in an internal combustion engine. This combination is further characterized in that only one connecting opening is needed on the engine block for adding oil, for returning oil from the pressure regulating valve to the oil pan, and for accommodating the oil dip stick.

11 Claims, 4 Drawing Sheets

PRESSURE REGULATING VALVE FOR CRANKCASE VENTILATION IN AN INTERNAL COMBUSTION ENGINE

BACKGROUND OF THE INVENTION

This invention relates to a pressure regulating valve for crankcase ventilation in an internal combustion engine. Such pressure regulating valves for crankcase ventilation are disposed, for example, in the venting duct between the crankcase and the air intake filter or engine air intake manifold. Due to these pressure regulating valves there exists a continuous connection between the crankcase and the air intake side of the engine, through which the blow-by gases are sucked out and returned to the combustion process. The pressure regulating valve assures that the pressure in the crankcase will not fall below a specified level. A prevailing slight vacuum in the crankcase prevents the blow-by gas from escaping to the atmosphere. By regulating the crankcase pressure, an optimum sealing of the closed motor system is assured, so that no pollutants can escape into the atmosphere.

A pressure regulating valve is usually flange-mounted laterally on the motor and connected by appropriate ducts to the crankcase or air intake. Such valves are disclosed, for example, in publication No. VKD 7032 of Filterwerk Mann & Hummel GmbH.

On a motor, of course, a number of additional accessories are disposed, such as the distributor, oil filler tube, dip stick, fuel lines, injection valves, and the like. A disadvantage of this great number of additional devices is that they can make it difficult to inspect and service the engine.

SUMMARY OF THE INVENTION

It is therefore the object of the invention to provide a pressure regulating valve for the crankcase ventilation of an internal combustion engine which overcomes the foregoing disadvantages.

In particular, it is the object of the present invention to provide a crankcase ventilation pressure regulating valve which permits better oversight of at least a part of the components arranged on the motor.

These and other objects are achieved in accordance with the invention by providing a pressure regulating valve for venting an internal combustion engine crankcase, which valve has an inlet connection in communication with the crankcase for delivering crankcase gas and an outlet connection in communication with the air intake of the internal combustion engine, and which valve comprises a housing that has a substantially cylindrical shape and is combined with an oil filler tube for introducing motor oil into said crankcase and with an oil dip stick for measuring the oil level within the crankcase.

The important advantage of the solution in accordance with this embodiment of the invention is to be seen in the fact that a total of three components, which formerly were arranged at different locations on the motor, are now combined into a single unit. This unit, namely the pressure regulating valve, the oil filler tube and the dip stick, incorporates all the components needed for oil supply and monitoring, which are, for example, flange-mounted laterally on the engine, and it avoids the use of complex individual parts. This unit can be made, for example, of a heat-resistant plastic, and can be flange-mounted on the engine block at the point where the opening for the dip stick is provided. Through this opening crankcase oil can flow into the crankcase, so that any additional filler opening becomes superfluous. Furthermore, oil carried with the blow-by gases and separated from these gases in the pressure regulating valve is also returned through this opening.

Alternatively, the objects of the invention are achieved by providing a pressure regulating valve for venting an internal combustion engine crankcase, which valve comprises a cylindrical hollow body flange-mounted over an opening provided on an engine block of the internal combustion engine and having an inlet connection in communication with the crankcase for delivering crankcase gas and an outlet connection in communication with the engine air intake, the cylindrical hollow body also having a branch thereon for receiving an oil dip stick, an opening for introducing lubricating oil to the crankcase, and a cap for closing off the oil introducing opening, and in which the pressure regulating valve comprises a housing which has a substantially cylindrical shape and is integrated in the cap.

An advantage of this embodiment of the invention is to be seen in the fact that the pressure regulating valve is integrated in the cap of the oil filler tube. This renders unnecessary an additional branch or additional oil filler tube. Since the cap in this case is connected by a flexible tube to the air intake of the engine, the additional advantage is provided that the cap cannot be removed from the engine compartment and thus cannot be lost.

In accordance with a further preferred embodiment of the invention, the blow-by gas passing through the pressure regulating valve can be conveyed to the clean-air side of the engine air filter. The vacuum which prevails there is sufficient to assure effective regulation of the vacuum in the crankcase.

According to a further embodiment of the invention, provision is made for feeding the blow-by gases from the pressure regulating valve to the air intake manifold of the engine. In this case, however, it must be remembered that higher vacuums occur in the air intake manifold, so that the pressure regulating valve must be dimensioned accordingly.

In order to facilitate combination of oil filler tube, dip stick and blow-by gas duct, a pressure regulating valve of the type disclosed, for example, in German Utility Model No. DE-G 78 22 216 is used. A pressure regulating valve of this kind has a very compact construction.

It is also possible to use a pressure regulating valve of the kind described in U.S. Pat. No. 4,373,499. Such a pressure regulating valve operates even when the vacuum used for ventilation fluctuates considerably, and is likewise of very compact construction.

BRIEF DESCRIPTION OF THE DRAWINGS

The invention will be explained in further detail below with reference to preferred embodiments illustrated in the accompanying drawings in which.

DETAILED DESCRIPTION OF PREFERRED EMBODIMENTS

Figure 1:
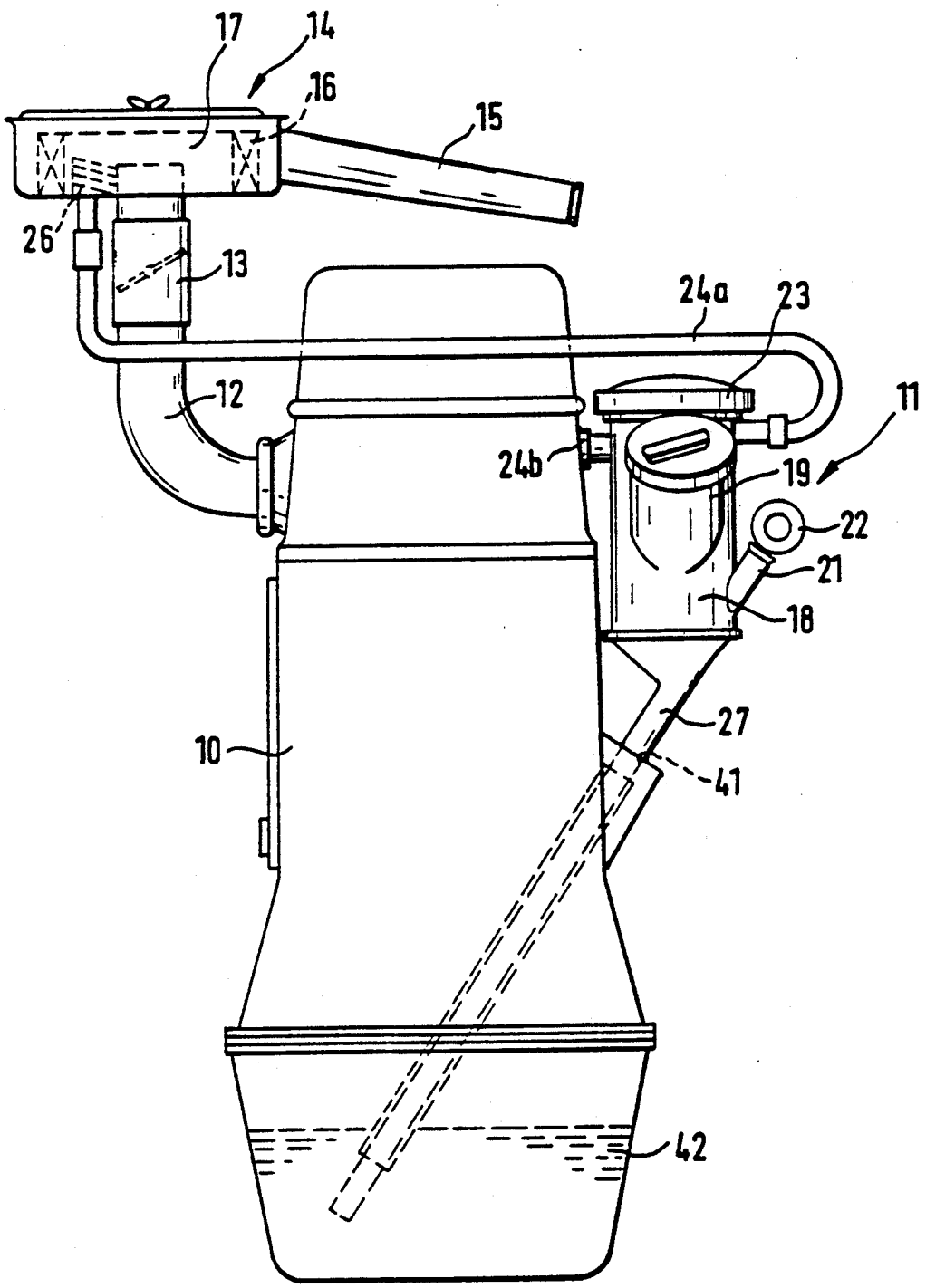
FIG. 1 is a schematic representation of an engine block with the valve combination of the invention flange-mounted thereon.

FIG. 1 is a schematic representation of an engine block 10 provided with a valve combination unit 11 according to the invention. An air filter 14 on an air intake tube 12 with a choke valve 13 also is disposed on the engine block 10. Raw air enters through a damper tube 15 into the air filter housing and passes through an air filter insert 16 to a clean-air chamber 17.

The valve combination 11 comprises a hollow cylindrical body 18 on which there is a branch 19. This branch is in the form of an oil filler tube and can be closed with a cap 20. The cap is provided, for example, with a conventional bayonet lock.

Hollow cylindrical body 18 has an additional branch 21 in which an oil dip stick 22 is received. A pressure regulating valve 23 is disposed at the top of the hollow cylindrical body 18 and closes the top of the body. A duct 24*b* leads from the engine into this pressure regulating valve and carries blow-by gases from the engine crankcase to the valve. An outlet line 24*a* serves to carry away the blow-by gases and is connected to the clean-air side of the air filter. An anti-backfire device 26 is arranged on this outlet line 24*a* where the line enters the air filter housing.

Hollow body 18 tapers at the bottom and assumes the form of a tube 27 through which the oil dip stick 22 extends and which also serves as a conduit for oil being added or recycled to the engine crankcase. This tube 27 is flange-mounted directly on the engine block.

Figure 2:
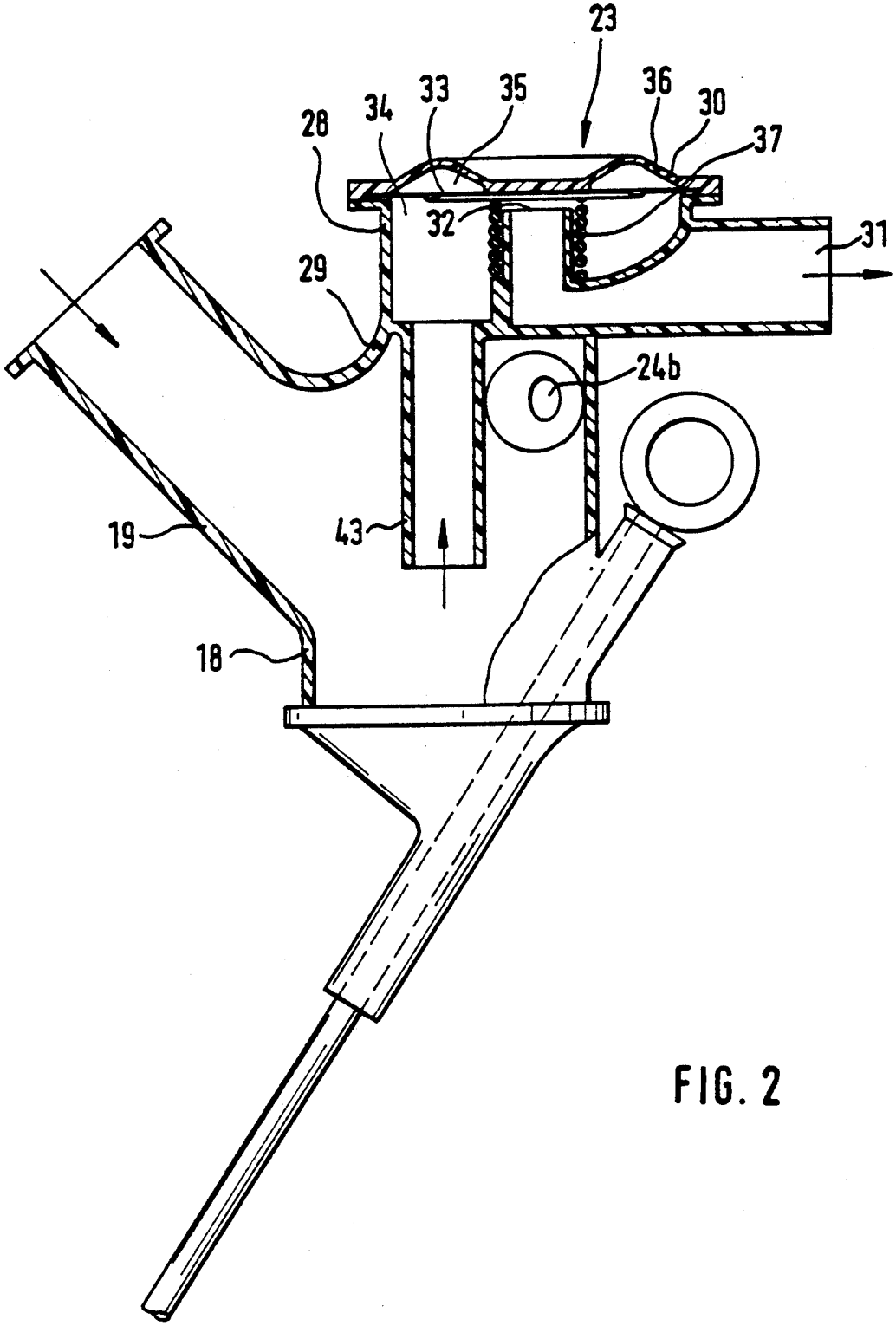
FIG. 2 is a cross-sectional view of a valve combination of FIG. 1 with the oil filler tube offset by 90 degrees and the cap omitted for clarity of illustration.

FIG. 2 is a detail of the valve combination of FIG. 1 which shows a cross section of the pressure regulating valve 23. In this figure, to facilitate comprehension, the branch 19 is shown offset by 90 degrees, and the cap has been omitted for the sake of simplicity.

The pressure regulating valve 23 comprises a valve housing 28 which is integrated directly into the hollow body 18. The housing 28 is composed of a pot-like lower portion 29 and a cover 30 fastened thereon. The inlet from the duct 24*b*, through which blow-by gases from the crankcase are introduced into the valve, opens into the lower portion 29 of the housing.

An outlet connection 31 leads to the outlet line 24*a* shown in FIG. 1. The inner end of the outlet connection 31 is disposed centrally within the valve housing 28 and forms a valve seat 32.

Within the valve 23 is a diaphragm valve body 33. The outer margin of diaphragm valve body 33 is clamped between the lower portion 29 of the housing and the housing cover 30 so that the diaphragm valve body divides the valve housing into a valve chamber 34 and a venting chamber 35. The venting chamber 35 is connected by a vent 36 to the atmosphere.

A compression spring 37 is arranged in the lower portion 29 of the housing so that one end of the spring pushes against the bottom of the housing and the other end of the spring pushes against the diaphragm valve body 33, thereby urging the diaphragm valve body toward the open position shown in FIG. 2 when the pressure conditions call for it, e.g., when the internal combustion engine, to which the unit is connected, is stopped.

When the vacuum in the air intake system of the internal combustion engine reaches a predetermined level, the atmospheric pressure in the vent chamber 35 will force the diaphragm valve body 33 to close against the valve seat 32, so that this high vacuum will not be communicated to the crankcase of the internal combustion engine. The valve o shuts off the crankcase venting until a newly produced blow-by develops a high enough pressure to reopen the valve.

The entire hollow body 18 can be made of a plastic, for example, in which case, if it is made by injection molding, the lower portion 29 of the pressure regulating valve 23 is integrated with the rest of the hollow body.

Figure 3:
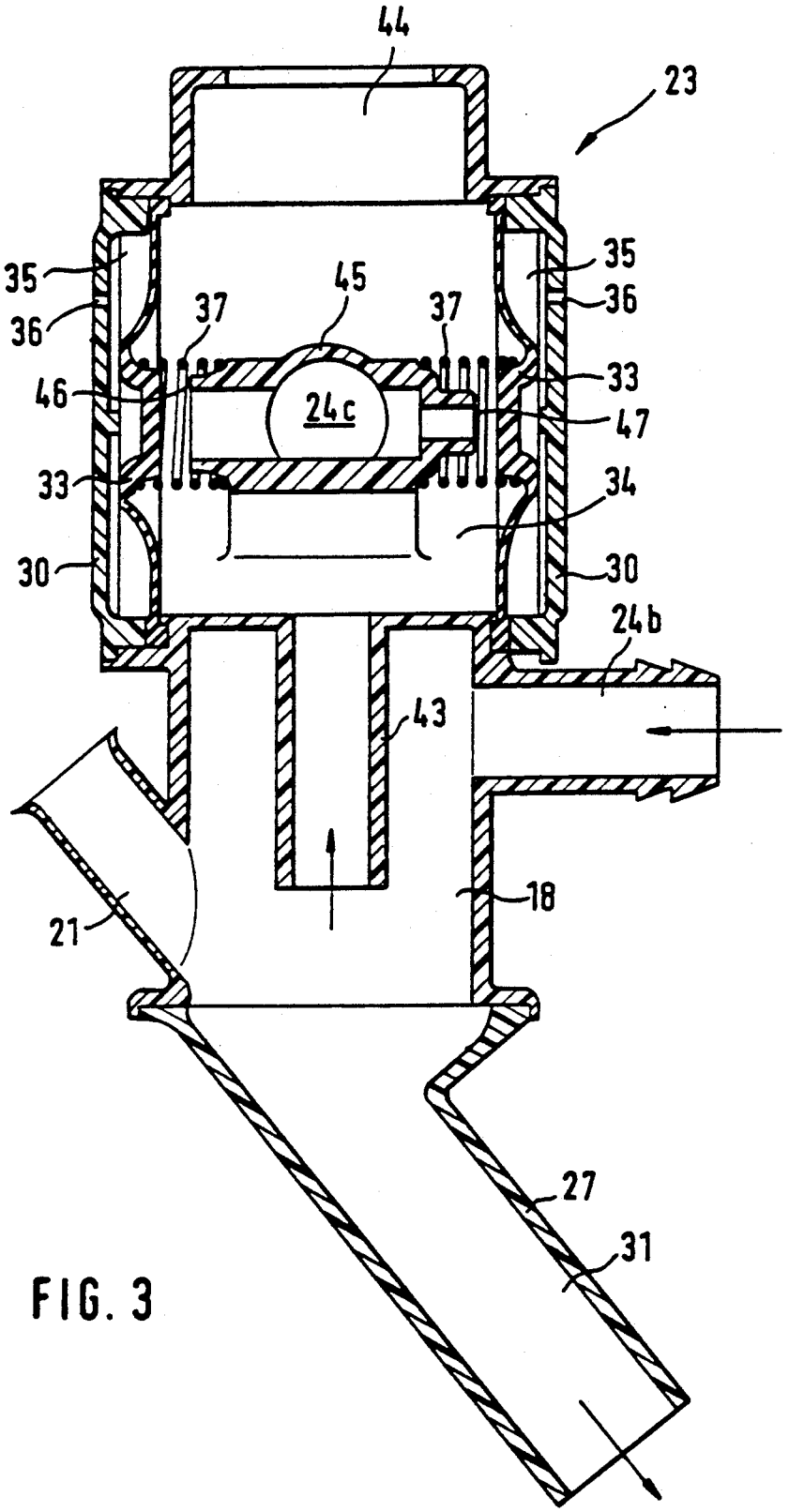
FIG. 3 is a cross-sectional view of a valve combination for a double valve for connection to the engine air intake manifold.

FIG. 3 shows a valve body with a double valve for connection to the air intake manifold in which substantially higher vacuums occur than in the filter (approx. 800 mbar). A similar double valve is disclosed in U.S. Pat. No. 4,373,499, the disclosure of which is hereby incorporated by reference.

The double valve sits on a cylindrical hollow body 18 which is flanged to the tube 27. This tube serves simultaneously as an outlet connection 31. A branch 21 is provided for receiving an oil dip stick, which is not shown.

The double valve consists of two housing covers 30 behind which are the venting chambers 35. These venting chambers are closed off by two diaphragm valve bodies 33. The valve housing is formed with an annular groove 48 thereon which is open toward the housing cover 30, and the diaphragm valve body 33 has a thickened margin 49 sealingly clamped in this annular groove by the housing cover 30. If there is little or no vacuum in the air intake manifold, these valve bodies 33 are held in the positions illustrated by two compression springs 37. The compression springs in turn are supported on a central valve portion which is provided with two valve seats, 46 and 47.

The central valve portion 45 has an outlet 24*c* which communicates with a duct leading to the air intake manifold. Underneath the pressure regulating valve is the connection for the line 24*b* to the crankcase. The oil-laden crankcase gases are introduced through this line into the hollow body 18. Within this hollow body 18 is a tubular extension 43 which produces a cyclone effect so that the crankcase gases which enter from line 24*b* are initially caused to rotate or whirl. This causes a large part of the entrained oil to deposit itself on the inside wall of the hollow body 18, so that the blow-by gases entering the pressure regulating valve through the tubular extension 43 are largely freed of the oil.

At the top of the pressure regulating valve 23 is an oil filler tube 44 which can be closed by a conventional cap, not shown.

Figure 4:
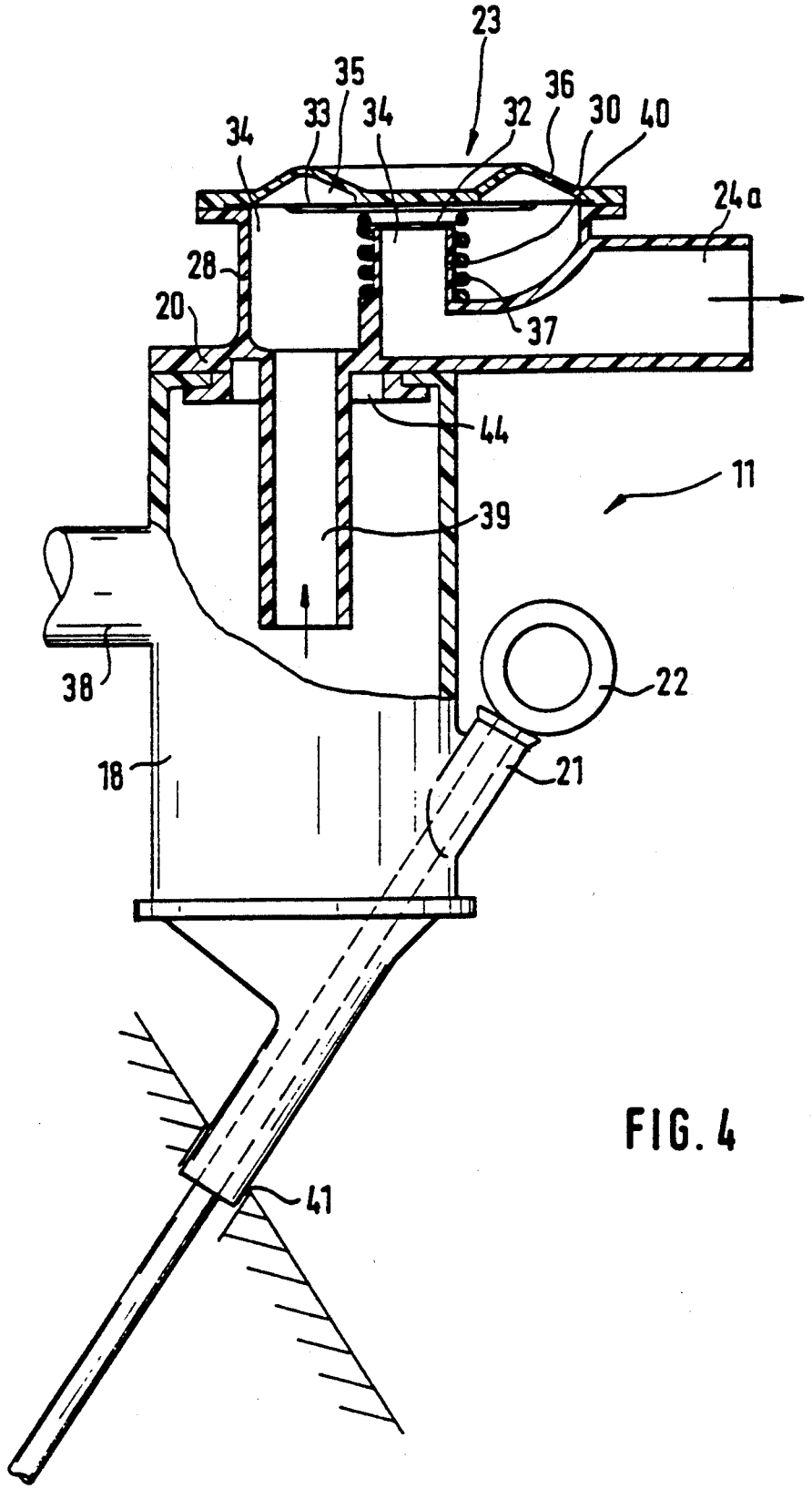
FIG. 4 is a schematic representation of a variant embodiment of the valve combination of the invention in which the valve housing is integrated with the oil filler cap.

FIG. 4 shows an alternative to the valve combination depicted in FIG. 2. In this alternative embodiment the pressure regulating valve 23 is situated in the cap 20 which closes the oil fill opening at the top of hollow cylindrical body 18. As it can be seen in the drawing, no additional branch is needed for the oil fill opening. The valve combination 11, as it is shown here, is characterized by an especially compact construction.

Blow-by gas escaping from the crankcase is introduced through connection 38 into hollow body 18. This blow-by gas passes through an opening 39 in the cap 20 into the valve chamber 34. In this valve chamber there is a diaphragm valve body 33 which is urged toward the illustrated open position by a compression spring 37. The compression spring 37 surrounds the valve seat 32 which is formed by the tubular connection 40. The blow-by gases are delivered to the filter through this connection and line 24*a* shown in FIG. 1. A venting chamber 35 communicates with the ambient atmospheric pressure through a venting passage 36.

The outlet line 24*a*, which is connected to the pressure regulating valve 23, preferably is made flexible, so that it will be easy to remove the cap 20 when adding oil.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A pressure regulating valve for venting an internal combustion engine crankcase, said valve having an inlet connection (24*b*) in communication with the crankcase for delivery of crankcase gas and an outlet connection (24*a*) in communication with an air intake of the internal combustion engine, said pressure regulating valve (23) comprising a housing (28) having a substantially cylindrical shape, and being combined with an oil filler tube for introducing motor oil into said crankcase and with an oil dip stick (22) for measuring an oil level within said crankcase.

2. A pressure regulating valve according to claim 1, wherein a cylindrical hollow body (18) is flange mounted over an opening (41) provided on an engine block of the internal combustion engine, and a branch (19) of said hollow body forms the oil filler tube, and wherein an additional branch (21) is provided for receiving said oil dip stick (22), and the pressure regulating valve (23) closes the top of said hollow body (18).

3. A pressure regulating valve according to claim 1, wherein a cylindrical hollow body (18) is flange-mounted over an opening (41) provided on an engine block of the internal combustion engine, said cylindrical hollow body having a first branch (19) thereon on which the pressure regulating valve (23) is disposed and a second branch (21) thereon for receiving said oil dip stick (22), and wherein said hollow body has an opening at its top for introducing motor oil into the crankcase, and a removable cap (20) is provided for closing said opening.

4. A pressure regulating valve for venting an internal combustion engine crankcase, said valve comprising a cylindrical hollow body (18) flange-mounted over an opening (41) provided on an engine block of the internal combustion engine and having an inlet connection (38) in communication with the crankcase for delivering crankcase gas and an outlet connection (24*a*) in communication with an air intake of the internal combustion engine, said cylindrical hollow body (18) having a branch (21) thereon for receiving an oil dip stick (22), an opening for introducing lubricating oil to said crankcase, and a cap (20) for closing off said oil introducing opening, wherein said pressure regulating valve (23) comprises a housing (28) which has a substantially cylindrical shape and is integrated in said cap (20).

5. A pressure regulating valve according to claim 1, wherein the outlet connection in communication with the air intake of the internal combustion engine is a connecting line (24*a*) connected to the clean-air side of an air filter (14).

6. A pressure regulating valve according to claim 1, wherein the outlet connection in communication with the air intake of the internal combustion engine is a connecting line (24*c*) connected to an air intake manifold (12) arranged between an engine air filter (14) and engine intake valves of the engine.

7. A pressure regulating valve according to claim 1, wherein said valve housing (28) comprises a pot-like housing bottom portion (29) and a housing cover (30), with a duct (24*b*) in communication with the crankcase leading into the housing bottom portion (29) and with an outlet connection (31) leading out of the housing bottom portion (29), said outlet connection having an inner end configured as a valve seat (32) disposed centrally within the valve housing, said valve further comprising a diaphragm valve body (33) dividing said valve housing into a valve chamber (34) and a vent chamber (35), said diaphragm valve body (33) cooperating with said valve seat (32) to close the valve, a compression spring (37) for urging said diaphragm valve body toward an open position, and a vent (36) connecting said vent chamber (35) to the atmosphere, whereby said diaphragm closes said valve against the force of said spring when a predetermined vacuum exists in said valve chamber (34).

8. A pressure regulating valve according to claim 7, wherein said diaphragm valve body (33) has an outer margin clamped between said housing bottom portion (29) and said housing cover (30).

9. A pressure regulating valve according to claim 8, wherein said housing bottom portion (29) is formed with an annular groove thereon which is open toward the housing cover (30), and said diaphragm valve body (33) has a thickened margin sealingly clamped in said annular groove by said housing cover.

10. A pressure regulating valve according to claim 7, wherein said valve housing is formed of injection molded plastic material.

11. A pressure regulating valve according to claim 7, wherein said outlet connection is in communication with an air intake of the internal combustion engine.

* * * * *